219-121 SR

12/4/84 XR 4,486,240

United States Patent [19]

Sciaky

[11] Patent Number: 4,486,240

[45] Date of Patent: Dec. 4, 1984

[54] METHOD AND APPARATUS FOR HEAT TREATING

[75] Inventor: Peter D. Sciaky, Oak Lawn, Ill.

[73] Assignee: Sciaky Bros., Inc., Chicago, Ill.

[21] Appl. No.: 514,866

[22] Filed: Jul. 18, 1983

[51] Int. Cl.[3] ..... C21D 1/06

[52] U.S. Cl. ..... 148/4; 148/152; 219/121 EM

[58] Field of Search ..... 148/4, 152, 145, 39, 148/13; 219/121 EB, 121 EM

[56] References Cited

U.S. PATENT DOCUMENTS 4,179,316 12/1979 Connors et al. ..... 148/152
4,199,689 4/1980 Takigawa ..... 219/121 EB

FOREIGN PATENT DOCUMENTS 7325290 9/1969 Japan ..... 148/4
WO82/01016 4/1982 PCT Int'l Appl. ..... 148/4

*Primary Examiner*—L. Dewayne Rutledge
*Assistant Examiner*—S. Kastler
*Attorney, Agent, or Firm*—J. L. Solomon

[57] ABSTRACT

This invention relates to a method and apparatus for surface hardening metals over selected areas on a workpiece by means of a concentrated beam of electrons.

The electron beam is directed and focused to the surface of the workpiece and is caused to move continuously along a predetermined path over a localized area on the surface. The path is traversed a preset number of times while the instantaneous speed of the beam along the path is varied and the electron beam current is varied in order to bring the selected area of the workpiece above the transformation temperature and close to the melting temperature and maintain it at this temperature for a predetermined time.

The beam current is then discontinued to allow the material to be quenched and surface hardened locally.

5 Claims, 14 Drawing Figures

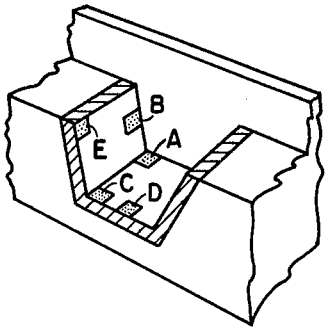
FIG. 11
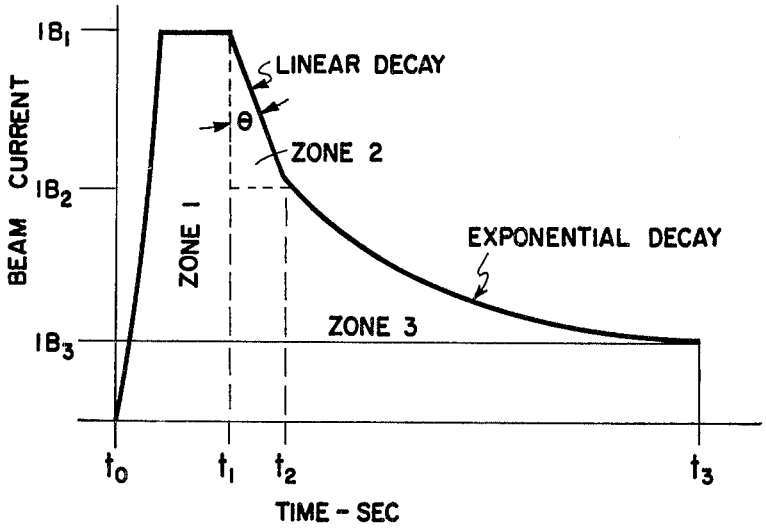
FIG. 12
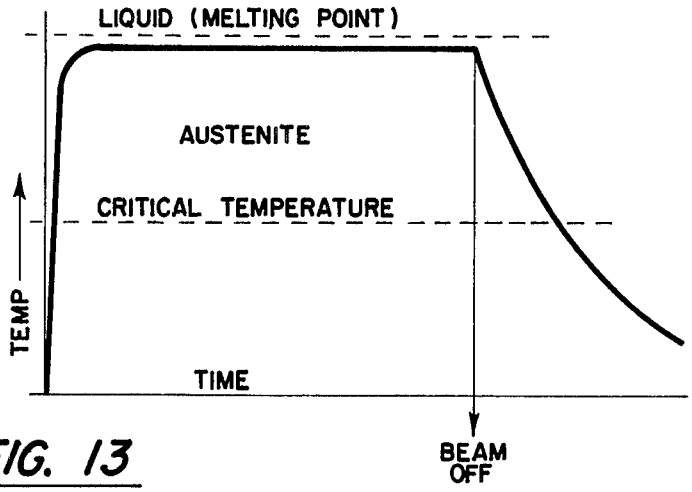
FIG. 13
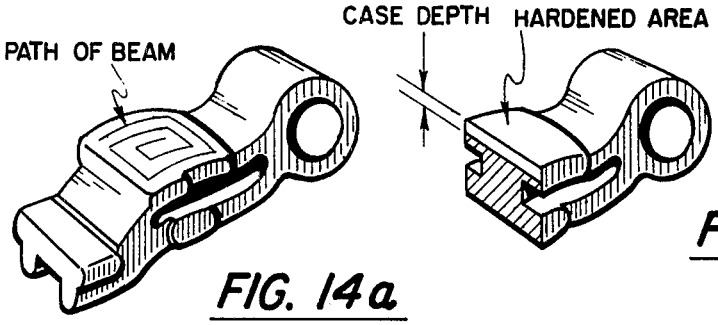
FIG. 14
FIG. 14a

METHOD AND APPARATUS FOR HEAT TREATING

This invention relates to a method and apparatus for heat treating metal surfaces and, in particular, for surface hardening by means of an electron beam concentrated to a high power density.

The heat treatment of metals is an important industrial process which is utilized to impart to the metal desirable properties such as toughness or hardness. For some applications, where steels are used for tools for working metals, it is necessary that the material be hardened to as great a depth as possible so that the tool retains its cutting properties so that it may be ground periodically as it wears. Steel at room temperature consists of two phases:

(1) Ferrite, which is essentially iron that has very small amounts of dissolved carbon and alloying elements; and (2) Carbides, which are composed mainly of alloying elements and carbon.

To be hardened, the steel must be heated above a certain temperature, where the ferrite transforms to another structure called austenite. The quantity of carbon which the austenite is capable of accepting depends on the temperature, and this quantity decreases as the temperature is lowered. If the austenite is quenched at a sufficiently rapid rate, the carbon is not able to precipitate out of solution and remains trapped in the structure. The trapped carbon produces a super-saturated solution in ferrite, which is called martensite. It is the capacity of the steel to keep the carbon in solution and undergo the martensitic transformation which is the important factor in hardening. There are many varieties of carbon tool steels and alloy steels each of which, when subjected to the proper heat treatment, result in a product having the desired characteristics for each specific application.

Whereas tools for metalworking require hardness throughout the material, there are many industrial parts which require a hard, wear-resistant surface and a ductile or tough core. Surfaces of such parts are hardened by carburizing, nitriding, cyaniding, or carbo-nitriding.

Carburizing requires that the parts be exposed to a carburizing gas at elevated temperatures for periods of about 5 to 72 hours or packed in a carburizing compound for this period. Carbon monoxide or methane is the carrier gas, and carbon dissolves in the austenite and penetrates below the surface by diffusion.

In nitriding, the parts are heated in an ammonia atmosphere at 450 to 540 degrees centigrade (950 to 1,000 degrees Fahrenheit) for about 8 to 96 hours. The material is hardened to a depth of up to 0.03 inches.

In cyaniding, small parts such as gears, ratchet pins and bushings are heated in a molten bath of sodium cyanide from 10 minutes to 4 hours and are then quenched in water or oil. The parts may be hardened by this method to a depth of 0.025 inches.

In the carbo-nitriding process, the parts are subjected to a gaseous atmosphere containing hydrocarbons and ammonia at a temperature of 1,200 to 1,650 degrees Fahrenheit.

Another process by which steel parts may be hardened is the induction heating process. The parts are held adjacent to, or within, a coil through which alternating current passes. High frequencies are used for small parts or for surface heating and low frequencies are utilized for heating in-depth.

The carburizing, nitriding and cyaniding processes are awkward to apply and are time-consuming. Hardening by the use of the induction heating process requires somewhat less time and may be done on a production line basis, but requires the use of specially shaped coils for each application.

Aside from the danger in working with noxious and poisonous gases and liquids and the production of air pollutants formed during the hardening process, all the above processes suffer from the inconvenience resulting from the parts becoming distorted during the process because they are subjected to high temperatures for long periods of time. If the parts become distorted, it becomes necessary to rework them by re-machining them to the required tolerance—a costly procedure made more costly because the parts are then in the hardened state.

The present invention is directed to the surface heat treatment of materials at extremely high speeds and is useful in overcoming the deficiencies in the above heretofore used methods of heat treating. The new heat treating process utilizes the high power density available in the electron beam, which is generated by accelerating a beam of electrons by means of a high potential electro-static field and directing the electron beam by focusing and deflecting it along two mutually perpendicular axes so that the beam is played upon the work in a desired two-dimensional pattern. In this manner, the parts may be heat treated at several localized areas without it being necessary to bring the total mass of the part to the proper heat treating temperature. Because of this, the total energy required by this new process is only a fraction of the energy which must be utilized in the older processes for heat treating the same parts. The type of parts which lend themselves to this method of heat treating include cams, spindles, rotors, bearing races, clutch stators, piston rings, tool joint ends, ball joints, cylinder liners, turbine blades, machine tool surfaces, valve seats, etc. With this process, the localized surface to be heat treated is rapidly brought to the proper temperature, maintained for a suitable length of time, and the treated area usually self-quenched by the surrounding mass of metal in the part. There is no need for a quenching medium such as a water spray or an oil bath to be utilized. During the heat treating process, the motion of the electron beam may be under control of a mini-computer which has been programmed by the operator to control the deflection coils of the electron gun along two axes so that the beam is caused to move continuously along a desired path on a localized area on the work surface in accordance with a preset program of instantaneous velocity.

Heretofore, surface heat treatment of metals has been effected by the method described in U.S. Pat. No. 4,179,316, granted to J. F. Connors, et al., on Dec. 18, 1979, and assigned to Sciaky Bros., Inc. This method utilizes an electron beam which is controlled so as to produce a desired pattern of separated points of impingement of the beam upon the work so as to form a dot matrix of spots on the work at which the beam is caused to rest for a preset period of time in sequence. In practicing this dot matrix method, it was discovered that the method could not be utilized to the best advantage inasmuch as the temperature at the points of impingement of the beam was found to be several hundred degrees greater than at those areas between points of impingement. If the current in the beam was then increased, in order to shorten the heat treatment time, it was found that hot spots were developed and local melting was experienced at the points of impingement of the beam upon the work. It was then discovered that a more uniform temperature distribution over the area intended to be surface hardened could be realized by utilizing an electron beam which was caused to move continuously over the area rather than a beam which was caused to rest for a predetermined time at an array of spots, as was done and described in U.S. Pat. No. 4,179,316. It was also discovered that by continuously moving the beam, but by varying the speed of the beam in accordance with the variations of heat flow from the various sections of the area being heat treated, it was possible to obtain a uniform temperature over the full area being heat treated. In order to practice the new method, a system was devised for translating a dot matrix pattern heretofore used for heat treating to a linear, continuous pattern. The heat treat matrix pattern which was defined by a set of dwell points is converted into a continuous line pattern by means of linearly interpolating digital to analog converter deflection signals. A four-pole, low pass programmable Bessel filter is utilized, and mathematically defined distribution functions are used to equalize the surface temperature. A linear interpolation circuit is used to convert a basically stationary beam at each dwell point into a continuously moving beam. In practicing the new method, one may start with a given array of dwell points, each point with a given dwell time for the electron beam. This array is formed on the surface of the workpiece by applying suitable staircase-pattern voltages, and the resulting current waves to the "X" and "Y" deflection coils of the electron beam gun cause the beam to be deflected so as to strike the work and produce a dwell raster pattern on a localized area on the surface of the work. In order to convert to a continuously moving beam, the staircase pattern for the "X" and "Y" deflection coils is processed by linear interpolation from step to step to produce a smoothly varying deflection signal. When the filtered voltage patterns are applied to the "X" and "Y" deflection coils, the result will be a continuously moving electron beam impinging upon the work surface rather than an array of hot spots caused by an intermittent motion of the beam from spot to spot, with the beam resting at each spot for a preset period of time. By means of linear interpolation, the staircase deflection voltage, creating a series of stationary beam positions has been transformed into a continuously moving electron beam. The continuous path of the electron beam, in accordance with the new invention, may be viewed on a cathode ray oscilloscope. It is the object of this invention to produce a uniform depth of case hardness over a given surface.

Another object of this invention is to perform the surface heat treatment over localized areas of intricately shaped parts with the least expenditure of energy and time.

Another object of the invention is to produce a continuously moving electron beam from an intermittently moving beam which produces a pattern of discrete heat spots upon a work surface over a localized area of that workpiece.

Another object of the invention is to produce a rapid rise in temperature over a localized area of a workpiece.

Another object is to produce a uniform temperature over a localized area of a workpiece.

Another object is to transform a dot matrix pattern of dwell points for the electron beam on a work surface to a continuously moving electron beam on the work surface.

Another object is to produce a continuously moving electron beam whose velocity with respect to the work surface at the point of impingement of the beam and that work surface is varied in accordance with the law of thermal heat flow from the point of impingement of the electron beam, as that thermal conduction varies from point to point and with time, so as to produce a uniform temperature over the surface being treated.

Another object of the invention is to surface harden a workpiece with a minimum of distortion resulting in the workpiece due to the hardening process.

These and other objects and advantages will become more apparent in view of the following detailed description taken in conjunction with the drawings described below:

Figure 3:
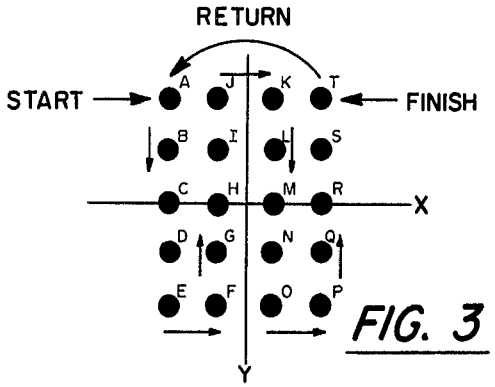
FIG. 3 illustrates a heat treat pattern utilized in the old process of heat treating by means of an electron beam, which is programmed to define a series of spots at which the beam dwells for a given period at each of the points identified by the letters "A" through "T".
Figure 4:
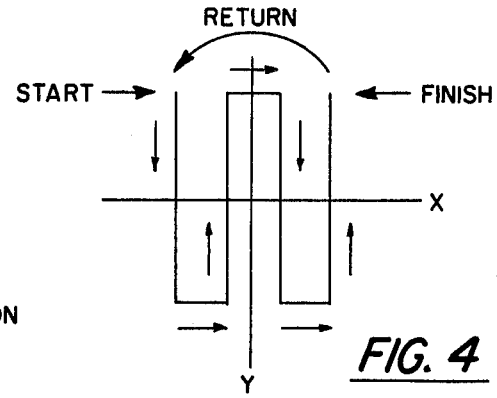
FIG. 4 illustrates the pattern of motion of the beam at the point at which it strikes the surface of the workpiece in accordance with the new method.
Figure 5:
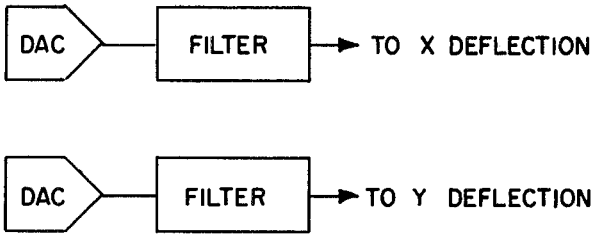
FIG. 5 is a block diagram illustrating the method by which the stepped electron beam motion represented by the dot pattern of FIG. 3 is transformed to the continuous electron beam motion represented by FIG. 4.
Figure 6:
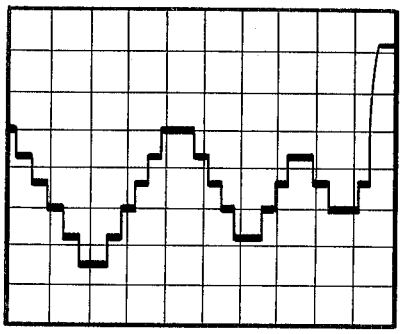
FIG. 6 shows a staircase voltage pattern for "Y" axis deflection which may be transformed to the voltage pattern of FIG. 7 in order to produce a continuous path pattern from a dot pattern over a triangular area.
Figure 7:
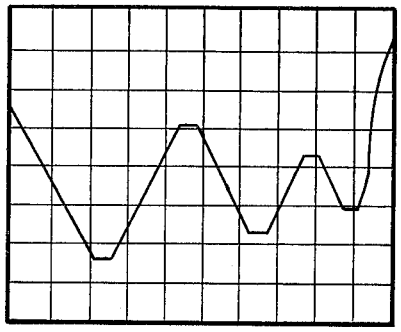
Figure 8:
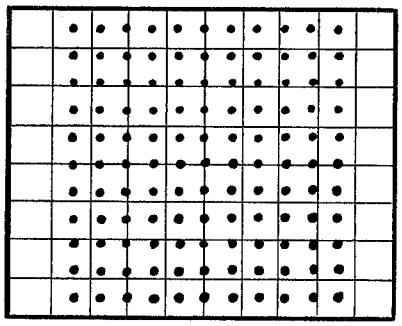
FIGS. 8 and 9 illustrate respectively a dot pattern and its continuous spiral path counterpart.
Figure 9:
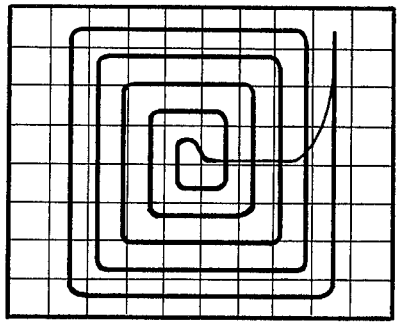
Figure 10:
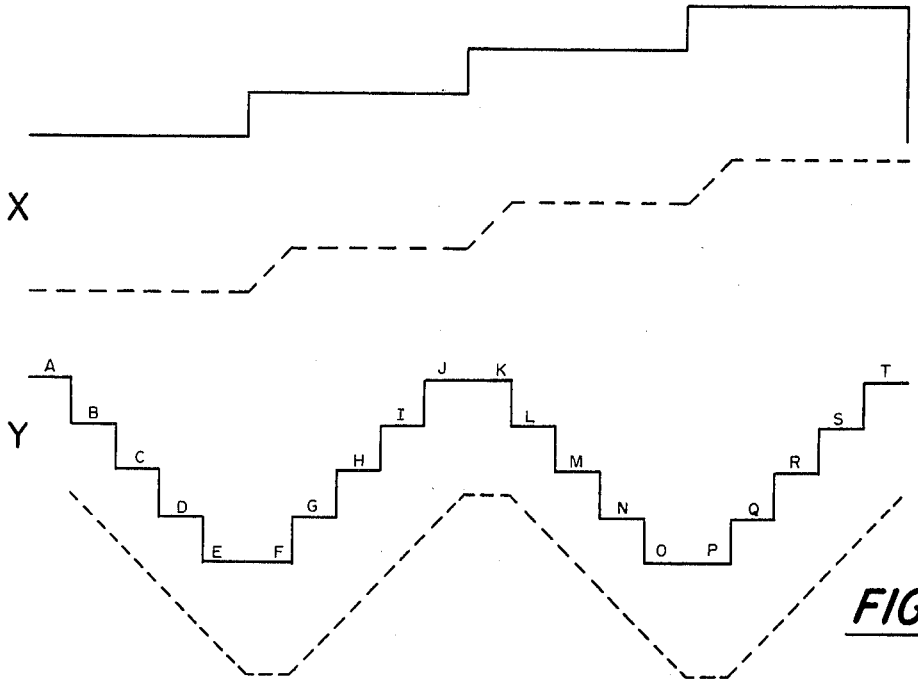

FIG. 10 shows graphically, by solid line, the pattern of voltages with respect to time which must be applied to the "X" and "Y" deflection coils in order to produce the stepped changes in position illustrated in FIG. 3 and shows, by broken lines, the pattern of voltages that must be applied to the "X" and "Y" deflection coils to cause the electron beam to follow the continuous pattern illustrated in FIG. 4.

FIG. 11 illustrates a portion of a workpiece which requires the application of different values of electron beam powers at different areas of the surface being treated.

FIG. 12 illustrates a program of variation in electron beam power with respect to the time which has been found to be most effective in practicing the new process.

FIG. 13 illustrates the temperature changes on the surface being treated.

FIG. 14 is a macrograph of a heat treated section of the workpiece.

Figure 1:
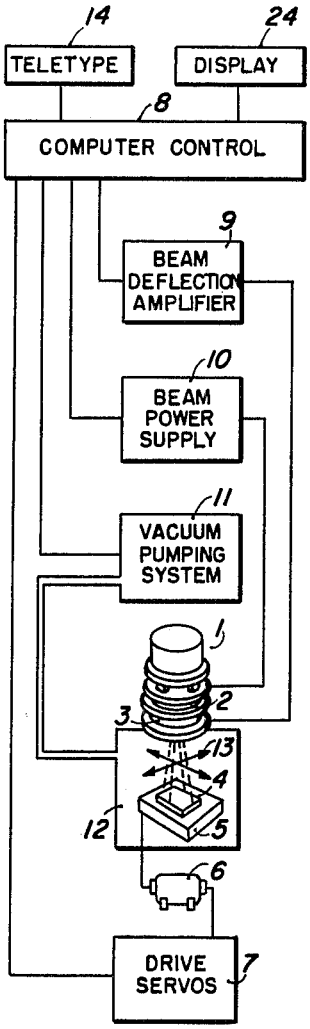
FIG. 1 is a block diagram showing the essential elements of the apparatus in accordance with this invention.

Referring now to FIG. 1, which illustrates the complete system for heat treating by an electron beam in accordance with the invention, we may note the electron beam gun "1" fitted with a focus coil "2", for focusing the electron beam on the work and deflection coils "3" for deflecting the beam along two mutually perpendicular axes so that the beam strikes the work to be heat treated in accordance with a predetermined program which has previously been placed in the memory of the computer control "8" by the system operator. The workpiece "4" is mounted upon a carriage "5" within a vacuum chamber "12" which is maintained at a low pressure suitable for the electron beam heat treating process by vacuum pumping system "11". The motion of carriage "5" is effected along several axes of required motion by means of servo motor "6" which is controlled by servo drive "7". The motor positions the carriage within the chamber so that the work will be properly positioned with respect to the resting position of the electron beam "13" which is deflected by the action of the magnetic fields of the "X" and "Y" axis deflection coils which are under control of beam deflection amplifiers "9", which in turn are controlled by information previously stored in the computer control memory. Computer "8" not only controls the beam deflection program, but also controls the electron beam gun parameters of accelerating potential, beam current, focus coil current, as well as the vacuum pumping system and the servo drives which are utilized to position in sequence a batch of parts supported by a suitable holding fixture within the chamber. In order to heat treat a batch of parts, the operator would mount the parts upon a supporting fixture inside the vacuum chamber, close the door of the vacuum chamber, and initiate the functioning of the machine by pressing a "start" button. The computer control then takes over the operation causing the vacuum valves to be operated so that the vacuum chamber "12" in which the parts have been placed is evacuated rapidly, the electron beam gun energized, and the beam controlled so that the desired heat treat pattern is projected onto the workpiece for the desired length of time, the electron beam gun deenergized, and the next part moved into position under the electron beam gun. The operation is extremely fast; a ten cubic foot chamber may be pumped down in less than 30 seconds and each part heat treated in a matter of 2 or 3 seconds to provide multiple part processing at very high production rates. In addition to controlling the operation of the machine functions, all parameters are monitored by suitable transducers and changes in the value of any of the parameters are displayed on the cathode ray oscilloscope "24". By means of a teletype "14" or other input device, the computer is programmed to provide a continuous output of 2-channel X/Y coordinate information. These two output signals are provided to the input terminal of a current amplifier "9" which controls the currents in an X/Y electro-magnetic deflection coil assembly "3". The deflection coil assembly "3" is used to deflect the electron beam passing through it along two mutually perpendicular axes. Thus, the output of the computer is used to deflect the electron beam in a program pattern for the purpose of selected surface heating. In previous attempts at electron beam heat treating, square, triangular and parabolic wave shapes of various frequencies were fed to the "X" and "Y" deflection coils of the electron beam gun system in order to cause the beam to sweep the surface of the work in accordance with the Lissajou patterns formed by the application of these signals to the deflection coils. The patterns developed on the work proved to be unsatisfactory and limited in application. The use of a computer to control directly the position of the electron beam provides infinitely variable control of average electron beam power and in the distribution of the electron beam power over the desired surface.

The advantages of computer controlled deflection over the previously tried methods are several:

(1) When projecting the Lissajou pattern upon the work surface, inherently there result many cross-over points and consequently, over temperature conditions occur at these points. With computer controlled deflection, beam path cross-over points are eliminated. The rate of surface heating can, therefore, be more rapid and accurately controlled since the energy delivered by the electron beam to the surface of the work is continuous along the path described by the beam along the work.

(2) The average beam power density can be very accurately controlled to provide heat inputs necessary for complex part geometries such as gears and cams.

(3) Using computer memory or other storage devices such as paper tape, magnetic drums or tape, pattern information for a variety of heat treating requirements can be stored for rapid recall and application.

(4) More sophisticated computer programs can be used to alter continuously the average power in the deflected beam so that complex geometries such as gears may be heat treated by rotation of the gear beneath the deflected beam.

(5) Deflection pattern information in the computer may be used to program other memory devices such as electronic memories which will provide pattern output signals and allow the computer to be used for other machine functions.

Figure 2:
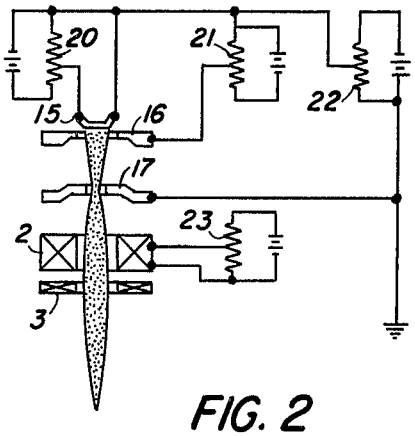
FIG. 2 is a schematic drawing of the essential elements of an electron beam gun and its power supply.

FIG. 2 illustrates in schematic form the general arrangement of the principal elements of an electron beam gun and its associated electrical supplies. The elements of an electron beam gun consist of a filament "15", a cathode "16", an anode "17", a focus coil "2", deflection coils "3", and their associated supplies "20", "21", "22" and "23". Filament current supply "20" delivers current to filament "15" and brings the temperature of the filament to the level at which it is in condition to deliver electrons. A high-voltage power supply "22" applies a potential of 60,000 volts to anode "17" with respect to the filament "15" to cause the electrons to be accelerated towards the anode and through an aperture in the anode so as to form a beam of electrons moving at a velocity which may approach the speed of light. The cathode "16" and anode "17" are shaped in such a manner as to create an electrostatic field between the anode and the cathode which causes the electron beam to be directed towards a point a short distance outside of the anode. An adjustable DC power supply "21" of approximately 2,000 volts is applied between the filament and the cathode and by this means the intensity of the electron beam current may be controlled. Increasing the negative potential on the cathode with respect to the filament reduces the electron beam current and vice versa. Beyond the opening in the anode there exists a field free space through which the beam passes through the focus coil "2" where it is focused to a desired spot on a workpiece by adjusting the focus current applied to the focus coil by power supply "23". Directly below the focus coil, the deflection coils "3" cause the beam to be deflected along two axes so as to cause the beam to impinge at a desired point upon the work. The output of all the various current and voltage supplies for the electron beam gun may be controlled by the computer and all may be programmed so that these values may be modified and varied so that the electron beam is caused to describe a preset pattern on the surface of the work in a given time and to repeat the pattern several times.

FIG. 3 illustrates a typical dot matrix pattern utilized in surface heat treating a local square section of a workpiece in accordance with the prior art. The continuous pattern of the present invention is illustrated in FIG. 4 and results from processing the deflection signals which produce the dot pattern in accordance with the following method. The wave form of the voltages which are applied to the deflection coils of the electron beam gun, in order to form the dot matrix pattern of the old art (as shown in FIG. 3, for example) may be translated and transformed to the wave form required to produce a continuously moving electron beam on the work surface as is illustrated in FIG. 4 in the following manner:

Referring first to FIG. 10, we see here graphically in solid lines the pattern of voltages with respect to time which must be applied respectively to the "X" and "Y" deflection coils in order to produce the stepped changes in position illustrated in FIG. 3 and by the broken lines of FIG. 10, the pattern of voltages that must be applied to the "X" and "Y" deflection coils to cause the electron beam to follow the continuous pattern illustrated in FIG. 4. On the solid line graph illustrated to the right of "Y" the various steps indicated by the letters "A", "B", "C", etc., refer to the stepped voltages which are applied to the "Y" axis deflection amplifier for a period of time indicated by the length of each step, and the solid line above the "X" indicates the stepped voltages which are applied to the "X" axis deflection amplifier, each step being applied for a time indicated by the length of the step. During the first step which defines the voltage applied to the "X" axis, the voltage applied to the "Y" axis steps from "A" level to "B" level to "C" level to "D" level to "E" level in order to cause the electron beam to move from "A" to "B" to "C" to "D" and to "E" as shown on FIG. 3. With the change in voltage to the second step shown on the "X" axis graph, the "Y" axis graph indicates a change in voltage through the steps "F", "G", "H", "I" and "J", which causes the electron beam to move upward along the "Y" axis to "F", "G", "H", "I" and "J" spots. As the voltages change in accordance with the stepped changes on the "X" and "Y" graphs, the electron beam is caused to move from "K" to "L", etc., to "T" and then, as the voltage changes depicted on the graphs repeat themselves, the electron beam repeats the motion and formation of the spot or dot pattern on the work. In practicing the new process, the voltages applied to the "X" and "Y" axis deflection amplifiers are those illustrated by the dotted lines, which voltages (when applied to their respective "X" and "Y" deflection amplifiers), will produce the motion shown in FIG. 4 from start to finish. The last-mentioned "X" and "Y" deflection signals (the smooth, continuous curves) are derived from the staircase type curves or voltage patterns in the following manner:

The analog signals representing the "X" and "Y" deflection voltages are delivered from a digital to analog conversion unit to a filter, preferably a four-pole, low pass Bessel filter, which linearly interpolates the wave form fed to it—that is, those illustrated by the solid curves of FIG. 10—to form the curves shown graphically in FIG. 10 by the dotted or broken lines. The resulting filtered wave forms are applied to the deflection amplifiers.

FIG. 11 illustrates a portion of a workpiece which requires the application of different amounts of energy at different points during the heat treat cycle. The area "A", which is a double inside corner, would require the greatest amount of heat input because the transmission of heat away from that area will be the greatest. Area "B", an inside corner, will require slightly less energy. Area "C", an inside-outside corner, will require still less. Area "D", an outside corner, and area "E", open on two sides, require the least energy input. By proportioning the energy input in this fashion, the temperature over the surface of the area to be heat treated may be brought to a uniform temperature throughout so that no melted spots will develop because of too high heat input or because of poor heat transmission from that particular area.

It has been found that the most effective and most rapidly accomplished heat treating is produced by applying a varying current at a fixed accelerating potential to the electron beam during the heat treat cycle. The wave form found to be most effective is the one illustrated in FIG. 12. The curve illustrates a three-zone current vs. time program. Zone 1 is a step to a high value of beam current, $I_{B1}$, with this value of beam current maintained for time $T_1$ seconds. Zone 2 consists of a linear downslope to a lower value of beam current, $I_{B2}$, during a time period $T_2$–$T_1$ seconds, and Zone 3 is the exponential decay to a third current level—$I_{B3}$. The application of this current wave form to the electron beam results in a temperature profile as illustrated in FIG. 13, which shows that the temperature rises to its proper value or desired value in less than 0.2 to 0.3 seconds and is maintained at this level until the material is properly treated, after which the current is turned off and the temperature allowed to decay asymptotically to the workpiece body temperature.

FIG. 14 is a cutaway view of a portion of the workpiece shown in FIG. 14A, surface hardened by the process of the present invention. The path taken by the beam during the hardening process is indicated on the area to be hardened on the automobile engine rocker arm illustrated in FIG. 14A.

A variety of workpieces requiring localized case hardened areas having various shapes and sizes have been successfully case hardened by the new process. The power of the electron beam has ranged from 10 kW to 50 kW. For example, a circular area of 1" diameter on a ½" plate of S.A.E. 4140 steel was hardened to 61 HRC to a case depth of 0.080" in two seconds. The total energy input required was 19,914 Watt seconds.

This remarkable result is due to raising the temperature of a thin layer at the surface from 60° F. to close to 2,700° F. in 200 milliseconds by means of the high power density inherent in the electron beam, maintaining this temperature in the desired volume for a preset period, and then rapidly quenching this volume by the cool underlying material of the workpiece. A uniform rapid rise in temperature over the area being treated is obtained by moving the electron beam in continuous fashion along a prearranged path over a portion of the surface of the workpiece.

By means of the above process, discrete and localized areas on a workpiece may be case hardened to a desired depth in a matter of from one-half second to 2 seconds depending upon the depth of case required.

There are other applications for surface heat treating; for example, the ways of a lathe or the periphery of a roller bearing or the periphery of cams used in gasoline engines, etc., which require surface heat treatment along a path which may be 0.5" to 1" wide and extend for several inches or as much as several feet. The present process has been utilized for such purposes by applying an electron beam to a workpiece so that it moves continuously in a desired pattern as described above over, for example, an area of dimensions 1"×1" and at the same time moving the workpiece with respect to the electron gun so that a series of overlapping patterns are formed on the work by the impingement of the beam on the moving workpiece. In this manner a path 1" wide of a desired length would be surface treated by the beam. The repetition rate for each pattern formed may be from 20 patterns per second to 800 patterns per second. Using an electron beam having a diameter of 0.1" at the work surface and with the work moving at a speed of 1 inch per second with respect to the electron gun would result in 20 patterns being generated over each inch of travel of the work, with a 50% overlap of each successive pattern.

By the above means, strips of case hardened material of a desired width and length may be formed wherever required on large machine parts.

What is claimed is:

1. A method of surface hardening selected areas of a metal workpiece by means of a concentrated beam of electrons comprising the steps of:

generating a beam of electrons;

directing the said beam of electrons to the surface of the said workpiece;

causing the beam to be displaced in continuous fashion in a predetermined pattern over said selected area of metal workpieces;

repeating said predetermined pattern of beam displacement on the surface of said workpiece a preset number of times at a rate above twenty times per second;

controlling the electron beam current so that it reaches so high an initial value that the material of said selected surface area reaches a temperature above the transformation temperature and close to but below the melting point for said material within 200 milliseconds;

maintaining the current at this level for a preset time of approximately 200 milliseconds;

lowering the electron beam current to a second level in linear fashion during a second preset time of approximately 200 milliseconds;

allowing the current to drop exponentially to a third level during a third interval; and interrupting the beam current at the end of the said third interval.

2. A method of surface hardening selected areas of a metal workpiece by means of a concentrated beam of electrons comprising the steps of:

generating a beam of electrons;

directing the said beam of electrons to the surface of the said workpiece;

causing the beam to be displaced in continuous fashion in a predetermined pattern over said selected area of the metal workpiece;

varying the beam velocity as the electron beam describes its predetermined pattern upon the surface of the workpiece;

repeating said predetermined pattern of beam displacement on the surface of said workpiece a preset number of times at a rate above twenty times per second;

controlling the electron beam current so that it reaches so high an initial value that the material of said selected surface area reaches a temperature above the transformation temperature and close to but below the melting point for said material within 200 milliseconds;

maintaining the current at this level for a preset time of approximately 200 milliseconds;

lowering the electron beam current to a second level in linear fashion during a second preset time of approximately 200 milliseconds;

allowing the current to drop exponentially to a third level during a third interval; and interrupting the beam current at the end of the said third interval.

3. A method in accordance with claim 1, including the step of varying the electron beam power density or its instantaneous speed as the electron beam describes its predetermined pattern upon the surface of the workpiece.

4. A method in accordance with claim 1 in which the said predetermined pattern of beam impingement upon the work surface is shifted incrementally with each successive complete pattern production so as to form a series of like patterns adjacent to one another on the surface of the workpiece.

5. A method in accordance with claim 1 in which the workpiece is caused to be translated so that the electron beam, in its motion on the surface of the workpiece, describes a series of partially overlapping predetermined patterns on said workpiece surface.

* * * * *